US008539704B2

(12) United States Patent
Honda et al.

(10) Patent No.: US 8,539,704 B2
(45) Date of Patent: Sep. 24, 2013

(54) LINERLESS PRICE REDUCTION CONTINUOUS LABEL, APPLYING METHOD AND PRINTING METHOD OF LINERLESS PRICE REDUCTION CONTINUOUS LABEL

(75) Inventors: Satoru Honda, Tokyo (JP); Mitsutaka Hanyuu, Tokyo (JP); Masashi Kosuda, Tokyo (JP)

(73) Assignee: Sato Holdings Kabushiki Kaisha (JP)

( * ) Notice: Subject to any disclaimer, the term of this patent is extended or adjusted under 35 U.S.C. 154(b) by 78 days.

(21) Appl. No.: 13/139,389

(22) PCT Filed: Jan. 19, 2009

(86) PCT No.: PCT/JP2009/050623

§ 371 (c)(1),
(2), (4) Date: Jun. 13, 2011

(87) PCT Pub. No.: WO2010/070934

PCT Pub. Date: Jun. 24, 2010

(65) Prior Publication Data

US 2011/0239508 A1 Oct. 6, 2011

(30) Foreign Application Priority Data

Dec. 16, 2008 (JP) ..... 2008-319388

(51) Int. Cl.
*G09F 3/10* (2006.01)

(52) U.S. Cl.
USPC ..... 40/638

(58) Field of Classification Search
USPC ..... 40/638, 674
See application file for complete search history.

(56) References Cited

U.S. PATENT DOCUMENTS 3,703,044 A * 11/1972 Gregory ..... 40/674
3,983,645 A * 10/1976 Rycroft ..... 40/630

(Continued)

FOREIGN PATENT DOCUMENTS

JP 8-26238 A 1/1996
JP 10-177344 A 6/1998

(Continued)

OTHER PUBLICATIONS

International Search Report dated Feb. 10, 2009, issued in corresponding international application No. PCT/JP2009/050623.

(Continued)

*Primary Examiner* — Joanne Silbermann
(74) *Attorney, Agent, or Firm* — Ostrolenk Faber LLP

(57) ABSTRACT

A linerless, preferably price reduction, continuous label which easily separates a price reduction indication region (11) and a bar-code cover-up region (12) of a single piece label (10) from a bar-code cover-up piece. There is a bar-code cover-up region (12). There are different separation strengths of the perforations including a first notch (15) and a second notch (16) of a price reduction region (11) that is capable of indicating price reduction information of an original price of a merchandise and a bar-code cover-up region (12) capable of covering-up the bar-code relating to the price information of the original price. A region separation line (13) is configured or a first perforation including a first notch (15) formed widthwise laterally inwardly from both lateral end portions of the label base member, and a unit joining line (14) configured of a second perforation including a second notch (16) formed widthwise laterally inwardly from both lateral end portions of the label base member. The second notch (16) is longer than the first notch (15).

19 Claims, 7 Drawing Sheets

(56) References Cited

U.S. PATENT DOCUMENTS

| | | | | |
|---|---|---|---|---|
| 5,129,682 | A * | 7/1992 | Ashby | 283/81 |
| 5,536,546 | A * | 7/1996 | Nash | 428/43 |
| 6,578,875 | B2 * | 6/2003 | Tamura et al. | 283/114 |
| 8,109,537 | B2 * | 2/2012 | Raming | 283/81 |

FOREIGN PATENT DOCUMENTS

| | | | |
|---|---|---|---|
| JP | 10-340050 | A | 12/1998 |
| JP | 2001-183984 | A | 7/2001 |
| JP | 2004-279840 | A | 10/2004 |
| JP | 2004-348087 | A | 12/2004 |
| JP | 2006-215236 | A | 8/2006 |
| JP | 2006-330673 | | 12/2006 |
| JP | 2007-199140 | A | 8/2007 |
| JP | 2008-129037 | A | 6/2008 |
| JP | 2008-216888 | A | 9/2008 |

OTHER PUBLICATIONS

English translation of the Written Opinion issued in corresponding PCT/JP2009/050623.

Notice of Reasons for Rejection issued by the Japanese Patent Office for Japanese Patent Application No. 2008-319388 (and an English translation).

* cited by examiner

LINERLESS PRICE REDUCTION CONTINUOUS LABEL, APPLYING METHOD AND PRINTING METHOD OF LINERLESS PRICE REDUCTION CONTINUOUS LABEL

CROSS-REFERENCE TO RELATED APPLICATIONS

The present application is a 35 U.S.C. §371 national phase conversion of PCT/JP2009 050623/, filed Jan. 19, 2009 which claims priority of Japanese Application No. 2008-319388 filed Dec. 16, 2008, the contents of which are incorporated by reference herein. The PCT International Application was published in the Japanese language.

TECHNICAL FIELD

The present invention relates to a linerless price reduction continuous label, to an applying method and to a printing method for printing the linerless price reduction continuous label, and more particularly, for indication of price reduction of the formerly indicated price of the merchandise.

BACKGROUND ART

Previously, when applying a linerless price reduction label on top of a former price reduction label to conduct multiple price reductions, since a release material is coated over the entire surface of the originally applied linerless price reduction label, it is possible to easily remove the next linerless price reduction label that is applied over the original linerless price reduction label.

There is a problem that it is easy to dishonestly reuse (so-called dishonest tampering for replacement of the label) a linerless price reduction label, indicating the price reduction information. Another problem is that the tamper-proof cut itself has no effect, as the label is not torn off from the tamper-proof cut formed on the label base member.

Furthermore, when a bar-code label is printed with bar-codes relating to price information of the merchandise, it is required to cover-up at least a part of the bar-code with the price-reduction process to prevent reading of the bar-code. Therefore, it is requested to easily and reliably cover-up the bar-code.

In addition, for the purpose of simplification or efficiency of bar-code reading process, the above-mentioned bar-code may be applied on the back side of the merchandise packaging container. However, in order to efficiently sell price-reduced merchandise, there has been a demand to at least indicate a human-readable reduced price at an eye-catching place (typically, on the surface side) after invalidating the bar-code at the back side of the merchandise packaging container.

Furthermore, the linerless price reduction label does not have a liner or a release paper as the backing sheet. Therefore, it is necessary to form perforations (the separation perforations) at the borders between neighboring linerless price reduction labels of the linerless price reduction continuous label configured with multiple linerless price reduction labels, in order to separate the continuous label into single pieces of linerless price reduction labels.

In addition, as shown in prior art, Japanese Unexamined Patent Application First Publication No. 2006-330673, in a label provided with a cover up label piece, which can be torn off from the label body by the perforations (the tear-off perforations) to cover-up the above-mentioned bar-code relating to the merchandise price information, there is a possibility that either of the price reduction label body portion or the coverup label piece may be carelessly torn off from either of the perforations (the separation perforations or the tear-off perforations).

Therefore, there is a possibility that, the coverup label piece may be torn off, or the coverup label piece of the other label body may be torn off at the same time, or the like, before the single piece label body portion is separated from the continuous linerless price reduction label. As a result in actual use (in separating operation or tear-off operation), special attention will be required. Therefore, quick and simple handling of the linerless price reduction continuous label is difficult to achieve.

SUMMARY OF THE INVENTION

Technical Problem

The present invention has been made in view of the aforementioned problems. The object of the present invention is to provide a linerless price reduction continuous label, an applying method and a printing method of the linerless price reduction continuous label which is applicable for multiple overlays following multiple price reductions.

Another object of the present invention is to provide such a label method for which the tamper-proof cut formed on the label base member is effectively operable.

Another object of the present invention is to provide such a label which is capable of easily and reliably invalidating a bar-code relating to price information of merchandise.

Another object of the present invention is to provide such a, and method label which is capable of invalidating a bar-code, even if the bar-code relating to price information of merchandise is at a not noticeable place such as the back side of a merchandise packaging container, and which is also capable of indicating the reduced price at an eye-catching place, such as on the top surface side.

Another object of the present invention is to provide such a, and method label which enables separation of a single piece of linerless price reduction label (a label body including a price reduction indication region and a bar-code cover-up region) more easily from the linerless price reduction continuous label than a bar-code cover-up piece (the bar-code cover-up region).

Yet another object of the present invention is to provide such a, and method label which is capable of stably separating the price reduction indicating region and the bar-code cover-up region as a single piece of linerless price reduction label from the linerless price reduction continuous label.

Solution to Problem

The present invention joins a price reduction indication region capable of indicating a price reduction information of an original price of a merchandise and a bar-code cover-up region capable of covering-up a bar-code relating to price information of the original price through each perforation, forming an adhesive material layer and a release material layer in stripes (in streaks) on a label, in patterns corresponding to each other on the surface side and the back side of the label base member, and changing either the separation strength or the tear-off strength of the perforations, either (the separation perforation (the second notches) or the tear-off perforations (the first notches).

A first aspect of the present invention includes: a linerless price reduction continuous label comprising: a label base member; an adhesive material layer formed on a back side of the label base member; a heat-sensitive color forming layer formed on a surface of the label base member; a release material layer formed on an upper layer of the heat-sensitive color forming layer. There is a price reduction indication region capable of indicating a price reduction information of an original price indicated on a merchandise and there is a bar-code cover-up region capable of covering-up a bar-code relating to price information of the original price, separable by a region separation line. The price reduction indication region and the bar-code cover-up region are separably connected as a unit label of a linerless price reduction label by a unit joining line. The region separation line configured of a first perforation including a first notch formed widthwise inwardly from both end portions of the label base member. The unit joining line is configured of a second perforation including a second notch formed widthwise inwardly from both end portions of the label base member. The second notch is formed longer than the first notch.

A second aspect of the present invention relates to a method of applying a continuous linerless price reduction label. The linerless price reduction continuous label comprises: a label base member, an adhesive material layer formed on the back side of the label base member. A heat-sensitive color forming layer is formed on surface of the label base member. A release material layer is formed on an upper layer of the heat-sensitive color forming layer. A price reduction indication region is capable of indicating a price reduction information of an original price indicated on a merchandise. A bar-code cover-up region is capable of covering up a bar-code relating to price information of the original price. These regions are separable by a region separation line. The price reduction indication region and the bar-code cover-up region are separably connected as a unit label of a linerless price reduction label by a unit joining line.

The method of applying the linerless price reduction continuous label includes: configuring the region separation line with a first perforation including a first notch formed widthwise inwardly from both end portions of the label base member, and configuring the unit joining line with a second perforation including a second notch formed widthwise inwardly from both end portions of the label base member. The second notch is formed longer than the first notch. The bar-code cover-up region is separated from the price reduction indication region at the region separation line of the linerless price reduction continuous label. The bar-code cover-up region is applied such that it is overlaying on the bar-code relating to the original price information.

A third aspect of the present invention relates to a method of printing a linerless price reduction continuous label. The linerless price reduction continuous label comprises: a label base member, an adhesive material layer formed on a back side of the label base member, a heat-sensitive color forming layer formed on a surface of the label base member release material layer formed on an upper layer of the heat-sensitive color forming layer. A price reduction indication region is capable of indicating price reduction information of an original price indicated on a merchandise. A bar-code cover-up region is capable of covering up a bar-code relating to original price information. Those regions are separable by a region separation line. The price reduction indication region and the bar-code cover-up region are separably connected as a unit label of a linerless price reduction label by a unit joining line.

The method of printing the linerless price reduction continuous label includes: configuring the region separation line to be a first perforation including a first notch formed widthwise inwardly from both end portions of the label base member, and configuring the unit joining line by a second perforation including a second notch formed widthwise inwardly from both end portions of the label base member; and forming the second notch longer than the first notch. Then the price reduction information is printed on the price reduction indication region. Then the bar-code relating to the price reduction information is printed on the bar-code cover-up region.

The first perforations of the above region separation line may have shorter notches widthwise inwardly from the first notches facing both end portions of the label base member, and the second perforations on the unit joining line may have shorter notches widthwise inwardly from the second notches facing both end portions of the label base member.

The adhesive material layers on the back side of the label base member may be formed in stripes. The release material layers on the surface of the label base member may be formed in stripes corresponding to the adhesive material layers in stripes on the back side.

The non-adhesive material regions adjacent to the adhesive material layers on the back side of the label base member may be provided alternately with the adhesive material layers, and the non-release material regions adjacent to the release material layers on the surface of the label base member may be provided alternately with the release material layers.

The adhesive material layers may be positioned at both end portions of the label base member on the back side of the label base member, and the release material layers may be positioned at both end portions of the label base member on the surface of the label base member.

In the price reduction indication region, the tamper-proof cuts may be formed within the adhesive material layer regions.

In the bar-code cover-up region, it is possible to have a bar-code relating to the price reduction information printed.

The original price of the merchandise may be indicated in any form, such as the price indication label showing the original price applied on the packaging container of the merchandise, or the price indication of the original price previously printed on the packaging container of the merchandise.

Advantageous Effects of Invention

In a linerless price reduction continuous label, applying method and printing method of the linerless price reduction continuous label of the present invention, since the label is formed with the second perforations (the unit joining line) including the second notches from both end portions and the first perforations (the region separation line) including the first notches from both end portions, also with the second notches formed longer than the first notches, it is possible to reliably and stably separate the linerless price reduction label as a unit label at the second perforations.

In other words, from the linerless price reduction continuous label, first, it is possible to separate a single piece label, then from this linerless price reduction label (the price reduction indication region), it is possible to tear off a bar-code cover-up region as a bar-code cover-up piece, so that stable use can be ensured.

According to the first aspect of the invention, since the second notches are formed longer than the first notches, without carelessly separating the bar-code cover-up region from the price reduction indication region, it is possible to stably tear-off the single piece labels from the linerless price reduction continuous label.

According to the second aspect of the invention, the bar-code cover-up region is made such that by overlaying the bar-code relating to the price information of the original price, it is possible to prevent read errors by covering-up the original price.

According to the third aspect of the invention, since the reduced price is printed in the price reduction indication region and also the bar-code relating to the price reduction information is printed in the bar-code cover-up region, it is possible to cover-up the bar-code of the original price and also to read the bar-code of the new price reduction information on the same face (the face where the bar-code of the original price is indicated, for example, on the back side). This contributes to improvement of the efficiency of a calculation process at the cash resister.

DESCRIPTION OF EMBODIMENTS

Figure 1:
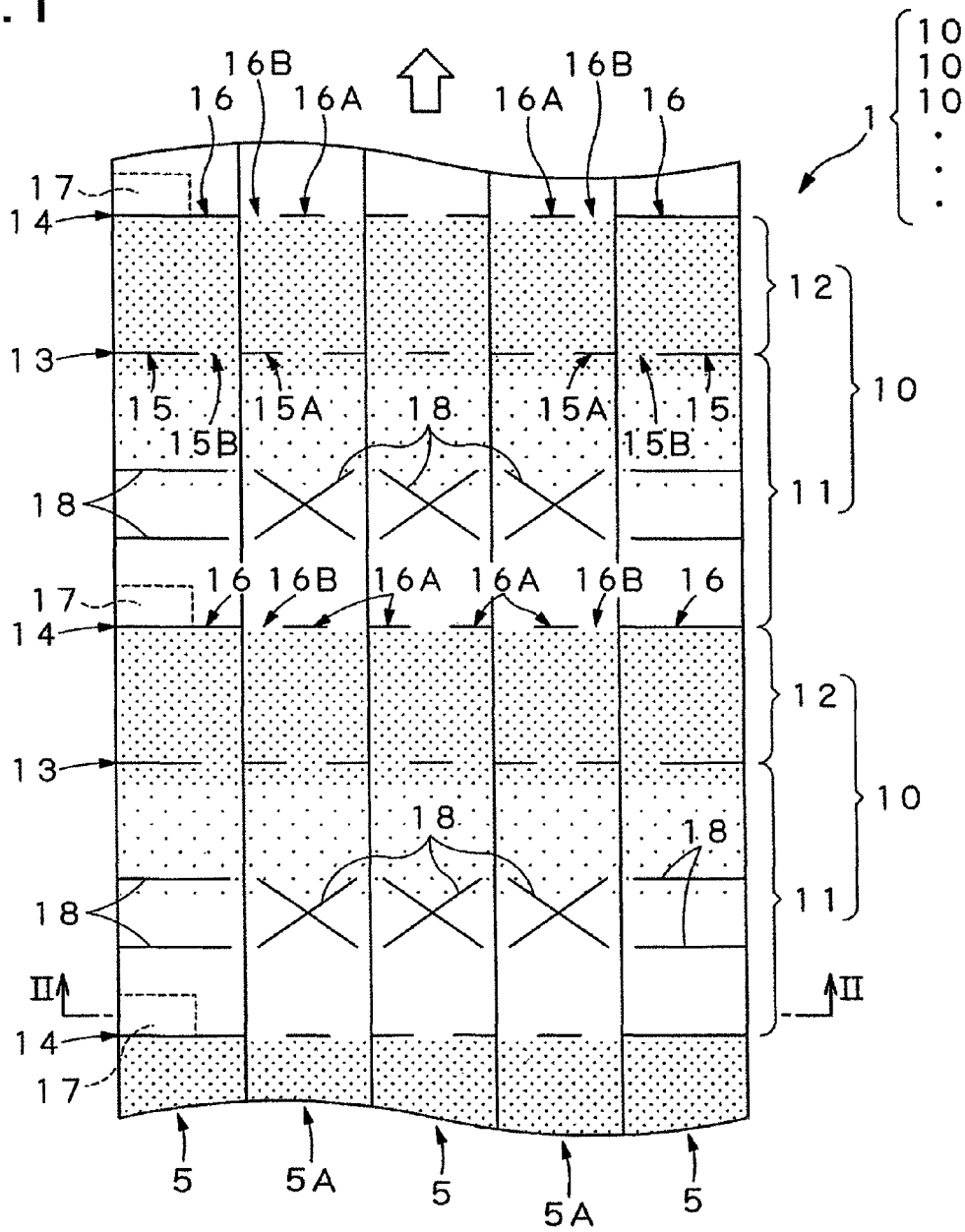
FIG. 1 is a plan view diagram of a linerless price reduction continuous label according to the first embodiment of the present invention.
Figure 2:
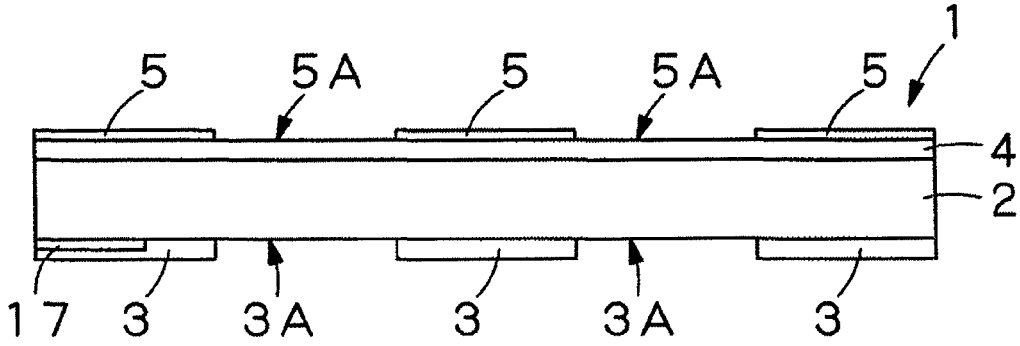
FIG. 2 is a cross-sectional view diagram of a linerless price reduction continuous label of FIG. 1 along the line II-II according to the first embodiment of the present invention.

The present invention provides a linerless price reduction continuous label, an applying method and a printing method of the linerless price reduction continuous label with superior functionality, operability and safety, as it is made to vary the length of the second perforations at the ends (the second notches) of the second perforations (the unit joining line) for separation of a single piece linerless price reduction label as a unit label from the linerless price reduction continuous label from the length of the first perforations as the ends (the first notches) of the first perforations (the region separation line) for separation of a bar-code cover-up region as a bar-code cover-up piece.

Hereinafter, a linerless price reduction continuous label 1, applying method and printing method of the linerless price reduction continuous label according to the first embodiment of the present invention will be explained based on FIGS. 1 through 5.

The linerless price reduction continuous label 1 is provided with a label base member 2, adhesive material layers 3 formed on the back side of the label base member 2, a heat-sensitive color forming layer 4 formed on the surface of the label base member 2, and release material layers 5 formed on the upper layer of the heat-sensitive color forming layer 4.

The adhesive material layers 3 on the back side of the label base member 2 are formed in longitudinal stripes in an array spaced along the width direction of the linerless price reduction continuous label 1. The release material layers 5 are on the surface side of the label base member 2 at locations corresponding to those of the adhesive material layers 3 at the back side, and are also formed in longitudinal stripes or streaks in an array spaced apart along the width direction.

The non-adhesive material regions 3A which are adjacent to and alternate with the adhesive material layers 3 extend in the length direction of the linerless price reduction continuous label 1. Also, the non-release material regions 5A which are adjacent to and alternate with the release material layers 5 extend in the length direction of the linerless price reduction continuous label 1.

In addition, a pair of the adhesive material layers 3 is positioned at both lateral edge regions of the label base member 2 on the back side of the label base member 2, and a pair of the release material layers 5 is positioned at both lateral edge regions of the label base member 2 on the surface side of the label base member 2.

Figure 3:
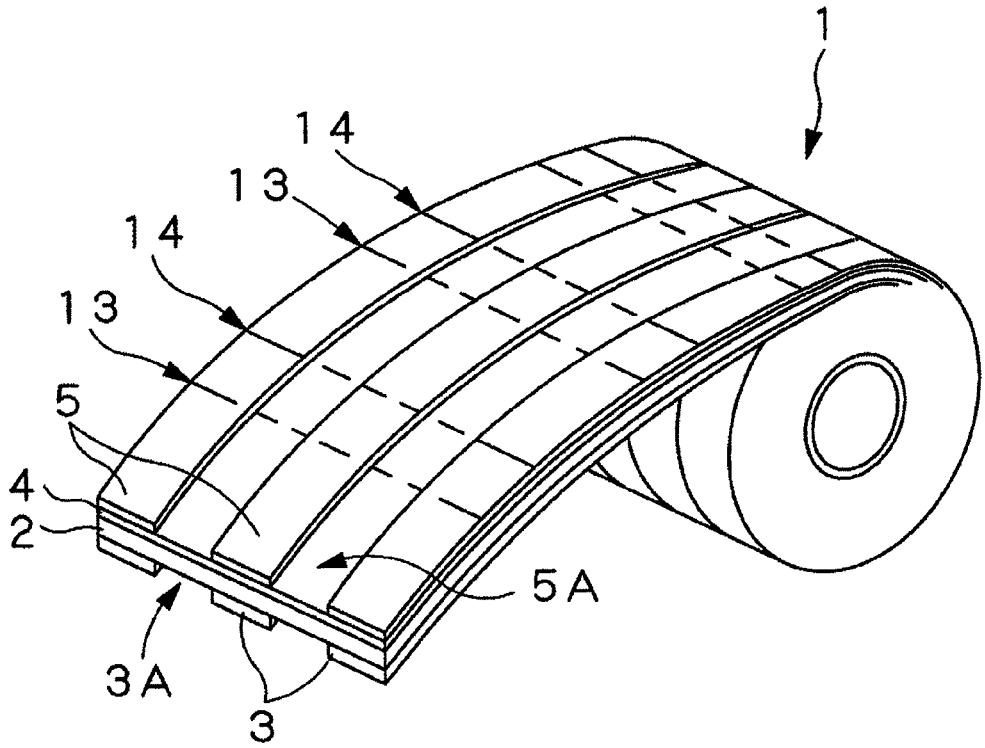
FIG. 3 is a perspective view diagram of a linerless price reduction continuous label wound in a rolled state according to the first embodiment of the present invention.

Thus, even if the linerless price reduction continuous label 1 is wound in a rolled state as shown in FIG. 3, the linerless price reduction continuous label 1 lying as a lower layer and an upper layer, the release material layers 5 on the surface (the upper layer side) control the adhesion with the adhesive material layers 3 on the back side (the lower layer side). Therefore, handling of the linerless price reduction continuous label 1 is not obstructed.

The above adhesive material layers 3 and the release material layers 5 may be provided in stripes in any way. It may be formed in the conveying direction (the length direction) or in the width or diagonal direction of the linerless price reduction continuous label 1. For each width of the adhesive material layers 3 and the release material layers 5, any width may be adopted according to the usage mode.

The linerless price reduction continuous label 1 is a continuous plurality of linerless price reduction labels 10 as single piece labels or unit labels. Each of the linerless price reduction labels 10 is provided with a price reduction indication region 11 which is the label body, and a bar-code cover-up region 12 which becomes a bar-code cover-up piece.

The price reduction indication region 11 is capable of indicating the price reduction information of the original price indicated on the merchandise.

The bar-code cover-up region 12 is capable of covering-up the bar-code relating to the original price information. The price reduction indication region 11 and the bar-code cover-up region 12 are separable from each other at the region separation line 13.

Furthermore, as unit labels of linerless price reduction labels 10, the price reduction indication region 11 and the bar-code cover-up region 12 are separably joined with the linerless price reduction label 10 by the unit joining lines 14.

The region separation line 13 is configured of first perforations including the first notches or cut lines 15 formed widthwise inwardly from both lateral edge end portions of the label base member 2. The first notches 15, at least, may be a single notch, and as in the shown example, the first notches 15 are formed as a pair of uniform right and left perforations at the lateral edge end portions of the label base member 2.

The unit joining line 14 is configured of second perforations including second notches 16 formed widthwise inwardly from both lateral edge end portions of the label base member 2. Each second notch 16, at least, may be a single notch. As in the shown example, the second notches 16 are formed as a pair of uniform right and left perforations at the lateral edge end portions of the label base member 2.

The second notches 16 are formed longer in the lateral direction than the first notches 15.

The first perforations of the region separation line 13 comprise shorter length notches 15A and connected portions 15B widthwise inwardly from the first notches 15 at both end portions of the label base member 2. The second perforations of the unit joining line 14 comprise shorter length notches 16A and connected portions 16B widthwise extending inwardly from the second notches 16 inward from both lateral edge end portions of the label base member 2.

Furthermore, on the backside of the each linerless price reduction label 10, there are position detecting marks 17 that are printed in advance, that are used when loading and conveying to a thermal printer (not shown) to print a rolled linerless price reduction continuous label 1.

Furthermore, in the price reduction indication region 11, at least in the region (the release material layer 5 region) provided with the adhesive layers 3, any number and form of tamper-proof cuts 18 are formed. The tamper-proof cuts 18 may also be formed in the non-adhesive material regions 3A (the non-release material regions 5A).

In addition, to the regions on the surface of the linerless price reduction continuous label 1 (the linerless price reduction labels 10), as necessary, it is possible to perform color coding according to any color design.

For example, as in the example shown in FIG. 1, the ground color of the portion from the bar-code cover-up region 12 to the price reduction indication region 11 can be shown in dark red ground color (in FIG. 1, shown with darks spots relatively high in density), and adjacent to this red ground color, a portion of the price reduction indication region 11 is shown in yellow ground color (in FIG. 1, shown with spots relatively coarse in density). By showing the other price reduction indication regions 11 with white ground color, it is possible to appeal the price reduction process to the consumers.

With the linerless price reduction continuous label 1 (the linerless price reduction labels 10) configured as above described, the price reduction information is printed on the price reduction indication region 11 by loading the linerless price reduction continuous label 1 on a thermal printer (not shown in the diagram). For this price reduction information, as well as the information relating to the price reduction process or the reduced price, it is possible to print a bar-code 22 (as shown in FIG. 4) relating to this price reduction information.

Figure 4:
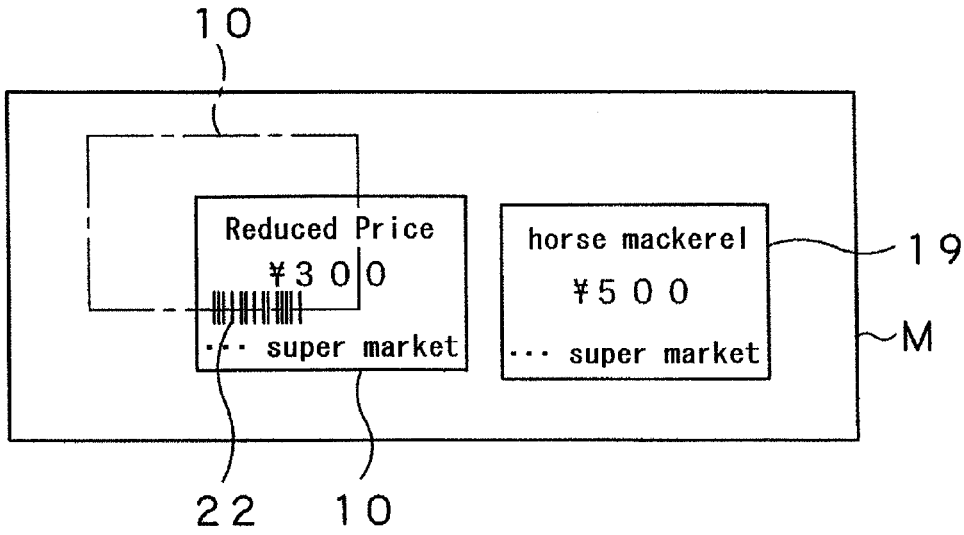
FIG. 4 is a plan view diagram of the surface side of a merchandise applied with an original price indication label indicating the original price according to the first embodiment of the present invention.
Figure 5:
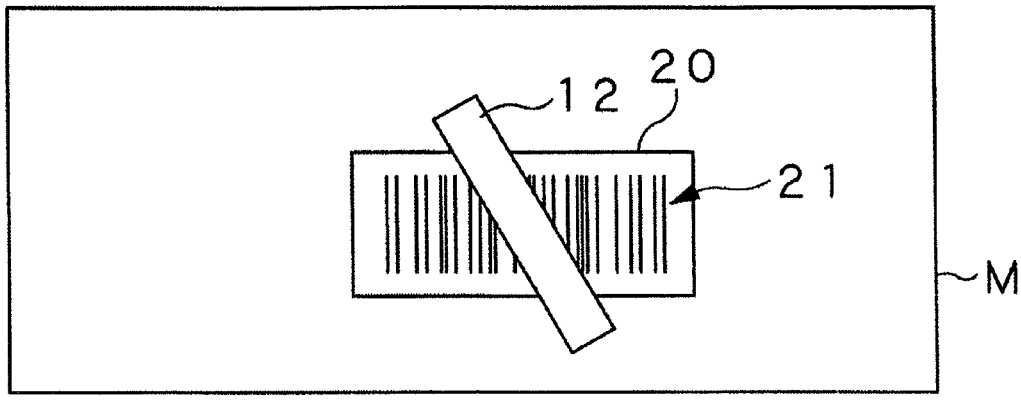
FIG. 5 is a back side view diagram of a merchandise according to the first embodiment of the present invention.

FIG. 4 is a plan view diagram of the surface side of a merchandise M applied with an original price indication label 19 indicating the original price, and FIG. 5 is a back side view diagram of a merchandise M. On the surface side of the merchandise M, to a position adjacent to the original price indication label 19 or to an eye-catching place, the linerless price reduction label 10 is applied to indicate the reduced price information.

In addition, on the back side of the merchandise M, a bar-code label 20 is applied on which a bar-code 21 relating to the price information of the original price is printed.

In FIG. 5, the bar-code cover-up region 22 is separated from the price reduction indication region 11 by the region separation line 13 portion of the linerless price reduction label 10. In FIG. 5, the bar-code cover-up region 12 is applied placed on top of the bar-code 21 relating to the price information of the original price.

Covering up the bar-code 21 by the bar-code cover-up region 12 makes optical reading of the bar-code 21 impossible. On the linerless price reduction label 10 (at the price reduction indication region 11), the bar-code 22 relating to the price reduction information is printed so as to enable reading of this bar-code 22 at the cash register.

The bar-code cover-up region 12 is separated from the price reduction indication region 11 at the region separation line 13. The linerless price reduction label 10 is separated from the linerless price reduction continuous label 1 at the unit joining line 14. Since the second notches 16 of the unit joining line 14 are formed longer widthwise across the strip of labels than the first notches 15 of the region separation line 13, the linerless price reduction labels 10, including 11 and 12 are easily separated from the linerless price reduction continuous label 1 at the line 14.

After this first separation, the price reduction indication region 11 and the bar-code cover-up region 12 of the linerless price reduction label 10 can be separated. This avoids problems, such as the bar-code cover-up region 12 being separated before the linerless price reduction label 10 is separated from the linerless price reduction continuous label 1 or two pieces of bar-code cover-up region 12 being separated with one piece of linerless price reduction label 10.

Therefore, when separating the linerless price reduction label 10, the operator who is carrying out the price reduction process by using the linerless price reduction continuous label 1 (the linerless price reduction label 10) can achieve efficient processing without requiring unnecessary attention.

Furthermore, as the adhesive material layers 3 and the release material layers 5 are formed in stripes on the surface side and the back side of the linerless price reduction labels 10, even if a multiple pieces of linerless price reduction labels 10 are overlaid and applied for multiple times of price reduction any of the adhesive material layers 3 at the upper layer side can be adhered to the non-release material regions 5A at the lower layer side such that their adhered state can be established and kept. Even if the linerless price reduction labels 10 are configured with the tamper-proof cuts 18 in the adhesive material regions 3, the tamper-proof function can be maintained.

Figure 6:
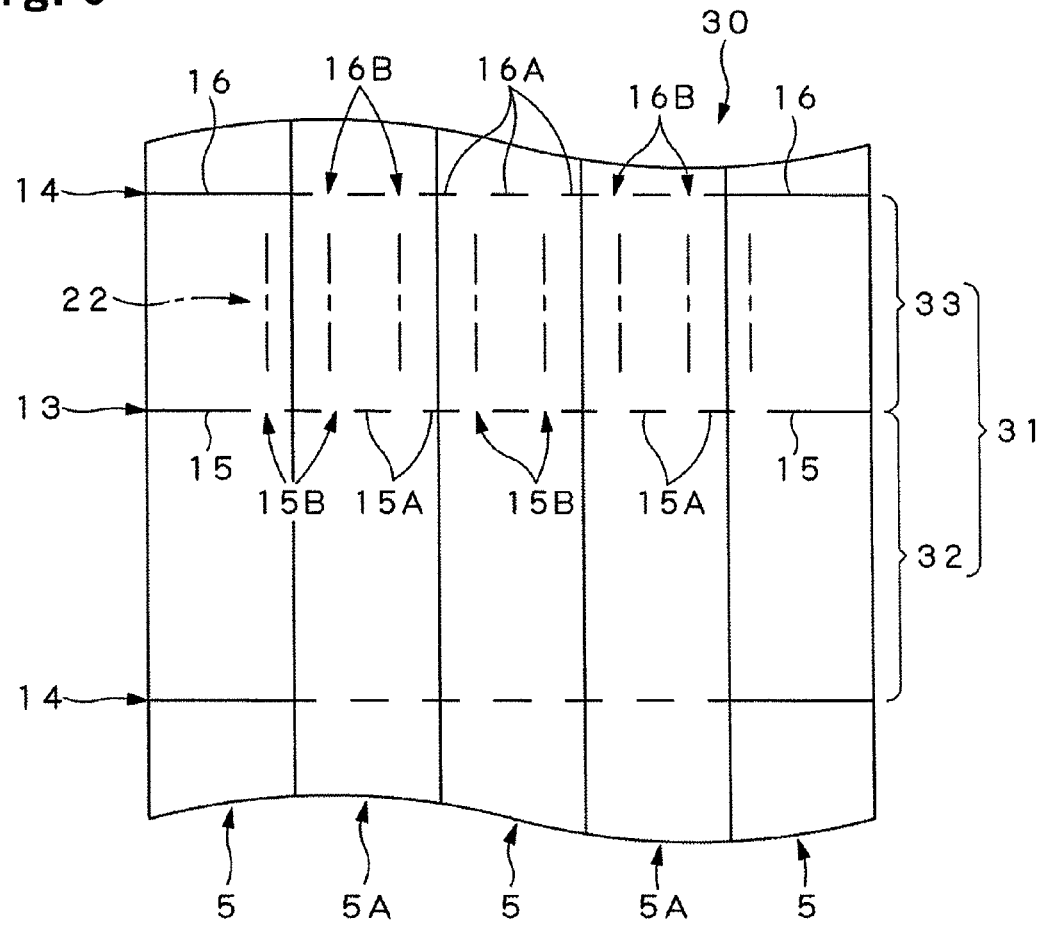
FIG. 6 is a plan view diagram of a linerless price reduction continuous label according to a second embodiment of the present invention.

FIG. 6 is a plan view diagram of a linerless price reduction continuous label 30 according to a second embodiment of the present invention. With the linerless price reduction continuous label 30, the linerless price reduction label 31 is a unit label, wherein the price reduction indication region 32 and the bar-code cover-up region 33 can be separated along the region separation line 13 including the first notches 15 and at the unit joining line 14 including the second notches 16 (formed longer than the first notches 15). This is the same as the linerless price reduction continuous label 1 (FIG. 1). However, as the bar-code cover-up region 33 has a white ground color, the bar-code 22 relating to the price reduction information of the original price can be printed in the bar-code cover-up region 33.

The linerless price reduction continuous label 30 (the linerless price reduction label 31) with such configuration, can be used in the same manner as the linerless price reduction continuous label 1 of FIG. 1, and can assure stable separation at the region separation line 13 and the unit joining line 14 portions.

Figure 7:
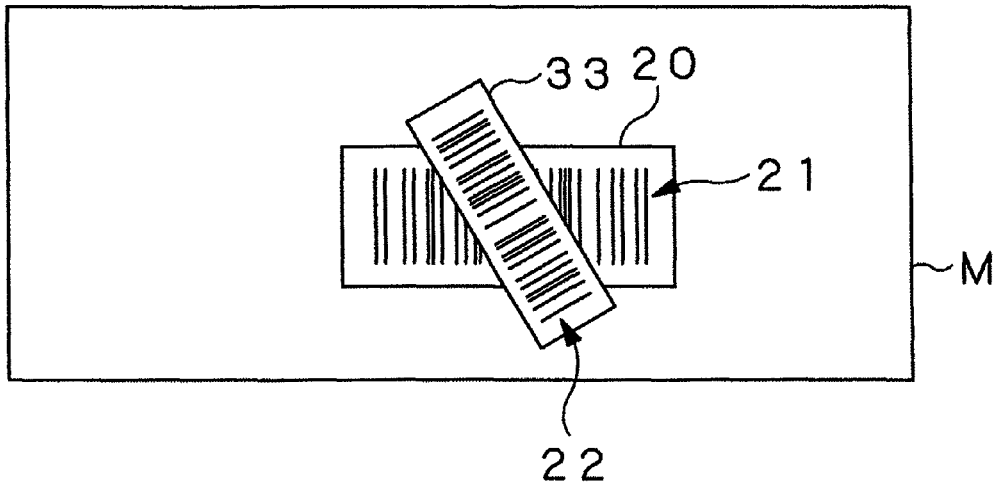
FIG. 7 is a back side view diagram of a merchandise as in FIG. 5 according to the second embodiment of the present invention.

FIG. 7 is a back side view diagram of the same merchandise M as in FIG. 5, wherein the bar-code cover-up region 33 printed with the bar-code 22 relating to price information of original price is applied to the portion of the bar-code 21 of the bar-code label 20 so as to cover-up the bar-code 21. By the application of the bar-code cover-up region 33 itself, it is possible to keep indicating the bar-code 22 on the same back side surface.

Therefore, at the cash register, it is not necessary to each time turn over the entire merchandise to read bar-code relating to price reduction information which is to be indicated on the surface side of the merchandise M as shown in FIG. 4. In other words, since it is possible to optically read the bar-code 22 on the back side of the merchandise M in the same manner as the normal merchandise M without price reduction, the bar-code reading process is efficient.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A linerless continuous label comprising:

a label base member having a front side surface and a back side and having lateral edge end portions;

an adhesive material layer on the back side of the label base member;

a heat-sensitive color forming layer on the front side surface of the label base member;

a release material layer on an upper layer of the heat-sensitive color forming layer;

an information indication region configured for indicating information and a bar-code cover-up region capable of covering-up a previously present bar-code, the regions being separable along a region separation line and each region being separable from an adjacent label base member in the linerless continuous label along a respective unit joining line, the information indication region and the bar-code cover-up region being separably connected at the region separation line to define a unit label in the linerless label;

the region separation line coinciding with a first line of perforation that includes a plurality of cuts arranged in a direction across the linerless label and between the lateral edge end portions of the label base member, the first line of perforation including first notches, each extending inwardly from a respective lateral edge end portion of the label base member, and each unit joining line coinciding with a second line of perforation that includes a plurality of cuts arranged in a direction across the linerless label and between the lateral edge end portions of the label base member, the second line of perforation being parallel to the first line of perforation and including second notches, each extending inwardly from a respective lateral edge end portion of the label base member; and wherein each second notch is longer than a first notch widthwise of the linerless label.

2. The linerless continuous label according to claim 1, wherein the first line of perforation of the region separation line has a first shorter length notch widthwise inwardly at the first notch facing both of the lateral edge end portions of the label base member, the first shorter length notch being shorter than the first notch, and the second line of perforation on the unit joining line has a second shorter length notch widthwise inwardly at the second notch facing both of the lateral edge end portions of the label base member, the second shorter length notch being shorter than the second notch.

3. The linerless continuous label according to claim 1, wherein the adhesive material layer on the back side of the label base member is formed in stripes, and the release material layer on the front side surface of the label base member is formed in stripes corresponding in location on the front surface of the label base member to the adhesive material layer in stripes on the back side of the label base member.

4. The linerless continuous label according to claim 1, further comprising:

a non-adhesive material region adjacent to the adhesive material layer on the back side of the label base member, the non-adhesive material region alternates with the adhesive material layer, and a non-release material region adjacent to the release material layer on the surface of the label base member, the non-release material region alternates with the release material layer.

5. The linerless continuous label according to claim 1, wherein the adhesive material layer is positioned at both of the lateral edge end portions of the label base member on the back side of the label base member, and the release material layer is positioned at both of the lateral edge end portions of the label base member on the surface of the label base member.

6. The linerless continuous label according to claim 1, further comprising a tamper-proof cut formed within the adhesive material layer region in the indication region.

7. The linerless continuous label according to claim 6, wherein the region separation line resides between and is parallel to two unit joining lines.

8. The linerless continuous label according to claim 1, further comprising a bar-code relating to the information printed in the bar-code cover-up region.

9. The linerless continuous label according to claim 8, wherein the region separation line resides between and is parallel to two unit joining lines.

10. The linerless continuous label according to claim 1, wherein the information is of an original price indicated on a merchandise.

11. The linerless continuous label according to claim 1, wherein the price information is of an original price indicated on a merchandise.

12. The linerless continuous label according to claim 1, wherein the region separation line resides between and is parallel to two unit joining lines.

13. The linerless continuous label according to claim 1, wherein a second notch extends from each lateral edge end portion.

14. A method of applying a linerless continuous label, wherein the linerless continuous label comprises:

a label base member having a front side surface and a back side and having lateral edge end portions;

an adhesive material layer on the back side of the label base member;

a heat-sensitive color forming layer on the front side surface of the label base member;

a release material layer on an upper layer of the heat-sensitive color forming layer;

an indication region configured for indicating information and a bar-code cover-up region capable of covering-up a previously present bar-code, the regions being separable by a region separation line;

the information indication region and the bar-code cover-up region are separably connected to define a unit label of a linerless label by a unit joining line;

the method of applying the linerless continuous label including:

configuring the region separation line by forming a first line of perforation across the linerless label between lateral edge end portions, the first line of perforation including first notches each formed widthwise of the label inwardly from a respective lateral edge end portion of the label base member, and configuring the unit joining line by a forming a second line of perforation across the linerless label between lateral edge end portions and parallel to the first line of perforation, the second line of perforation including second notches each formed widthwise inwardly from a respective lateral edge end portion of the label base member;

forming each second notch longer than a first notch widthwise of the linerless label;

separating the bar-code cover-up region from the price reduction indication region at the region separation line of the linerless continuous label; and applying the bar-code cover-up region such that it is overlaying on the bar-code relating to the information of the original price.

15. The method of claim 14, wherein the price information is of an original price indicated on a merchandise.

16. The linerless continuous label according to claim 14, wherein a second notch extends from each lateral edge end portion.

17. A method of printing a linerless continuous label, the linerless price reduction continuous label comprising:

a label base member having a front side surface and a back side and having lateral edge end portions;

an adhesive material layer on the back side of the label base member;

a heat-sensitive color forming layer on the front side surface of the label base member;

a release material layer on an upper layer of the heat-sensitive color forming layer;

an indication region configured for indicating information and a bar-code cover-up region capable of covering up a previously present bar-code the regions being separable by a region separation line;

the information indication region and the bar-code cover-up region are separably connected to define a unit label of a linerless label by a unit joining line; and the method of printing the linerless continuous label including:

configuring the region separation line by forming a first line of perforation across the linerless label between the lateral edge end portions, the first line of perforation including first notches each formed widthwise inwardly from a respective lateral edge end portion of the label base member, and configuring the unit joining line by forming a second line of perforation across the linerless label between the lateral edge end portions and parallel to the first line of perforation, the second line of perforation including second notches each formed widthwise inwardly from a lateral edge end portion of the label base member;

forming the second notch longer than the first notch widthwise across the label;

printing the information on the indication region; and printing the bar-code relating to the information on the bar-code cover-up region.

18. The method of claim 17, wherein the price information is of an original price indicated on a merchandise.

19. The linerless continuous label according to claim 17, wherein a second notch extends from each lateral edge end portion.

* * * * *

UNITED STATES PATENT AND TRADEMARK OFFICE

CERTIFICATE OF CORRECTION

PATENT NO. : 8,539,704 B2
APPLICATION NO. : 13/139389
DATED : September 24, 2013
INVENTOR(S) : Honda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 110 days.

Signed and Sealed this
Fifteenth Day of September, 2015

Michelle K. Lee

Michelle K. Lee
*Director of the United States Patent and Trademark Office*